US005890226A

United States Patent [19]

Snedeker et al.

[11] Patent Number: 5,890,226

[45] Date of Patent: Apr. 6, 1999

[54] FIREFIGHTER COAT WITH LINER SLEEVE WELLS AND WRISTERS

[75] Inventors: Julie A. Snedeker, Northwood; George E. Freese, III, Somersworth, both of N.H.

[73] Assignee: Globe Manufacturing Company, Pittsfield, N.H.

[21] Appl. No.: 971,130

[22] Filed: Nov. 20, 1997

[51] Int. Cl.[6] ..... A41B 7/00; A62B 17/00

[52] U.S. Cl. ..... 2/97; 2/81; 2/123

[58] Field of Search ..... 2/93, 87, 81, 97, 2/DIG. 5, 123

[56] References Cited

U.S. PATENT DOCUMENTS

| | | | |
|---|---|---|---|
| 5,208,919 | 5/1993 | Fields | 2/123 |
| 5,388,270 | 2/1995 | Hewitt | 2/93 |
| 5,701,606 | 12/1997 | Aldridge | 2/81 |

*Primary Examiner*—C. D. Crowder
*Assistant Examiner*—Tejash D Patel
*Attorney, Agent, or Firm*—Watson Cole Grindle Watson, P.L.L.C.

[57] ABSTRACT

The lower open end of the sleeves of the liner are detachably connected to the lower open end of the sleeves of the shell by attachments secured to the shell sleeves. The attachments include annular portions which overlap the lower ends of the liner sleeves to prevent liquid from flowing between the liner sleeves and the shell sleeves. Each liner sleeve includes an outer moisture barrier and an inner moisture barrier with a thermal barrier disposed between the inner and outer moisture barriers. The inner moisture barrier of each liner sleeve is permanently connected circumferentially to a wrister by stitching. The inner moisture barrier extends upwardly from the lower end of the liner sleeve and is then folded downwardly to the wrister, the inner moisture barrier being stitched to the thermal barrier adjacent the location where the inner moisture barriere is folded downwardly to form a sleeve well within the liner sleeve.

10 Claims, 2 Drawing Sheets

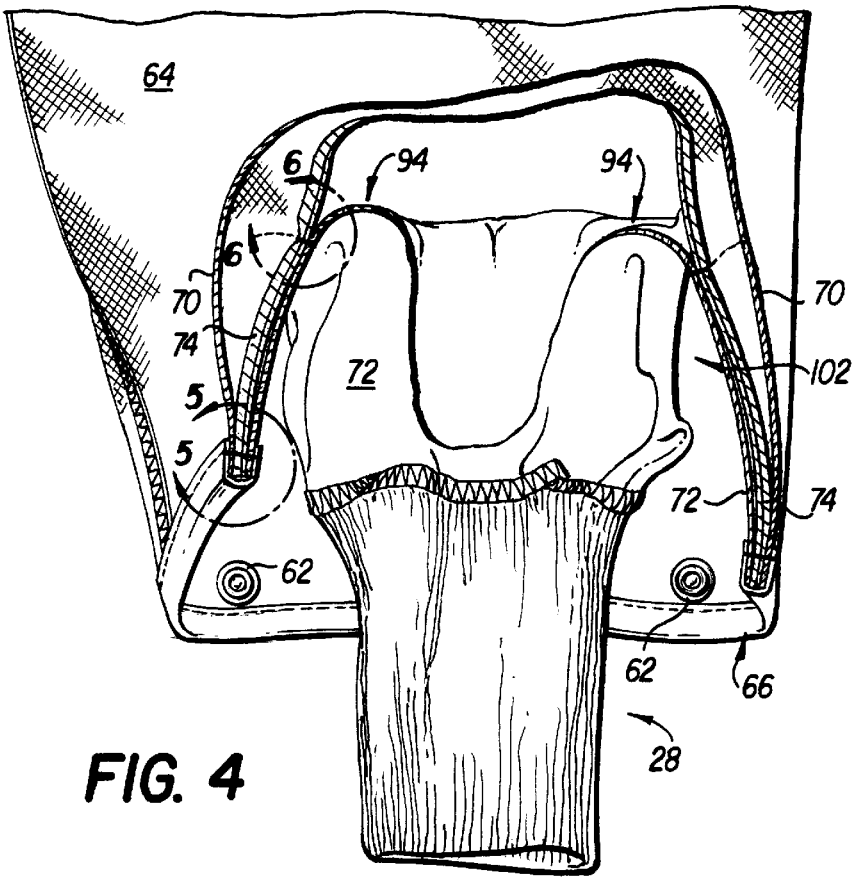
FIG. 4
FIG. 5
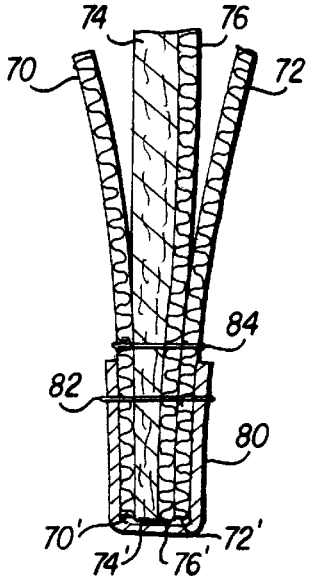
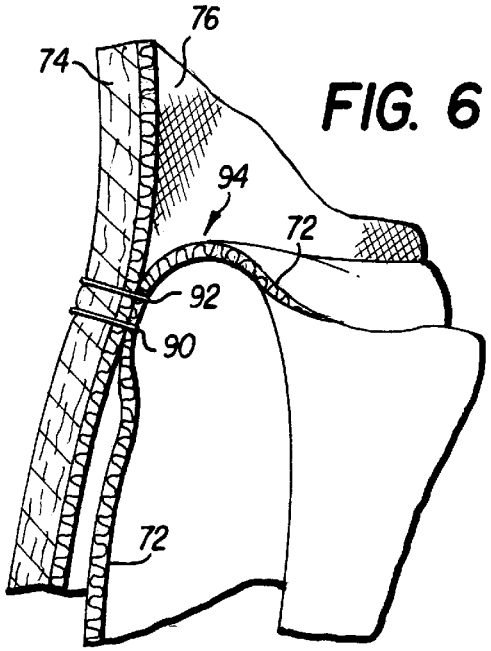
FIG. 6

FIREFIGHTER COAT WITH LINER SLEEVE WELLS AND WRISTERS

BACKGROUND OF THE INVENTION

The present invention relates to a firefighter coat, and more particularly to a firefighter coat wherein the sleeve wells or water wells disposed at the lower ends of the sleeves of the coat are disposed with the sleeves of the liner of the coat.

Firefighter coats include an outer shell designed primarily to resist burning or charring when exposed to flames along with a liner which fits within the outer shell and which is designed to serve as a moisture barrier and to provide thermal insulation. The outer shell has a pair of open ended sleeves, and the liner has a pair of open ended sleeves which fit within the sleeves of the shell. A sleeve well or water well is disposed at the lower end of the sleeves to prevent water from flowing into the sleeves especially when the arms of the firefighter are raised during firefighting activities.

Wristers are also provided at the lower ends of the sleeves and are adapted to receive the wrists of a firefighter and cooperate with the sleeve well to prevent water and other hazardous elements from entering the sleeves.

In some prior art constructions, it is possible that a gap can occur between the liner sleeve and the wrister, which is unacceptable since water or other elements can then enter the liner sleeves and come into contact with the arms of a firefighter.

The liner should be washed regularly and separate from the shell. Accordingly, means should be provided for selectively attaching or detaching the liner with respect to the shell.

It is desirable to provide a construction wherein the lower ends of the liner sleeves are disposed within one inch of the lower ends of the shell sleeves during firefighting operations, while retaining the thermal insulating and moisture proof characteristics of the coat. Accordingly, firefighter coats must be redesigned to enable the lower ends of the liner sleeves to be lower than in previous constructions while not diminishing the protection provided to the firefighter, including providing adequate sleeve wells at the lower ends of the sleeves.

SUMMARY OF THE INVENTION

The present invention incorporates a construction wherein the lower open ends of the sleeves of the shell are detachably connected to the lower open ends of the sleeves of the liner of the coat by attachment means which includes annular portions which overlap the lower ends of the associated liner sleeves. These overlapping portions prevent liquid or other materials from entering between the shell sleeves and the liner sleeves.

Each liner sleeve includes an outer moisture barrier and an inner moisture barrier, with a thermal barrier disposed between the inner and outer moisture barriers. The inner moisture barrier of each liner sleeve extends upwardly within the liner sleeve from the lower end of the liner sleeve a substantial distance and then is folded downwardly a substantial distance to an edge portion which is permanently connected by stitching to the upper edge portion of an associated wrister. This stitching extends circumferentially around the wrister so that the wrister cannot move away from the associated inner moisture barrier, and therefore no undesired material can enter between the wrister and the associated inner moisture barrier.

An intermediate portion of the inner moisture barrier is connected circumferentially to the thermal barrier which ensures that the inner moisture barrier forms an effective sleeve or water well within the lower end of each liner sleeve, thereby enabling the lower ends of the liner sleeves to be disposed within one inch of the lower ends of the shell sleeves which is a principal objective of the invention.

BRIEF DESCRIPTION OF THE DRAWINGS

FIG. 4. is a view partly broken away and in section of the lower part of the sleeve of a liner of the coat;

FIG. 5 is an enlarged view of the portion of FIG. 4 as indicated by arrows 5—5 in FIG. 4; and FIG. 6 is an enlarged view of the portion of FIG. 4 as indicated by arrows 6—6 in FIG. 4.

DESCRIPTION OF THE PREFERRED EMBODIMENT

Figure 1:
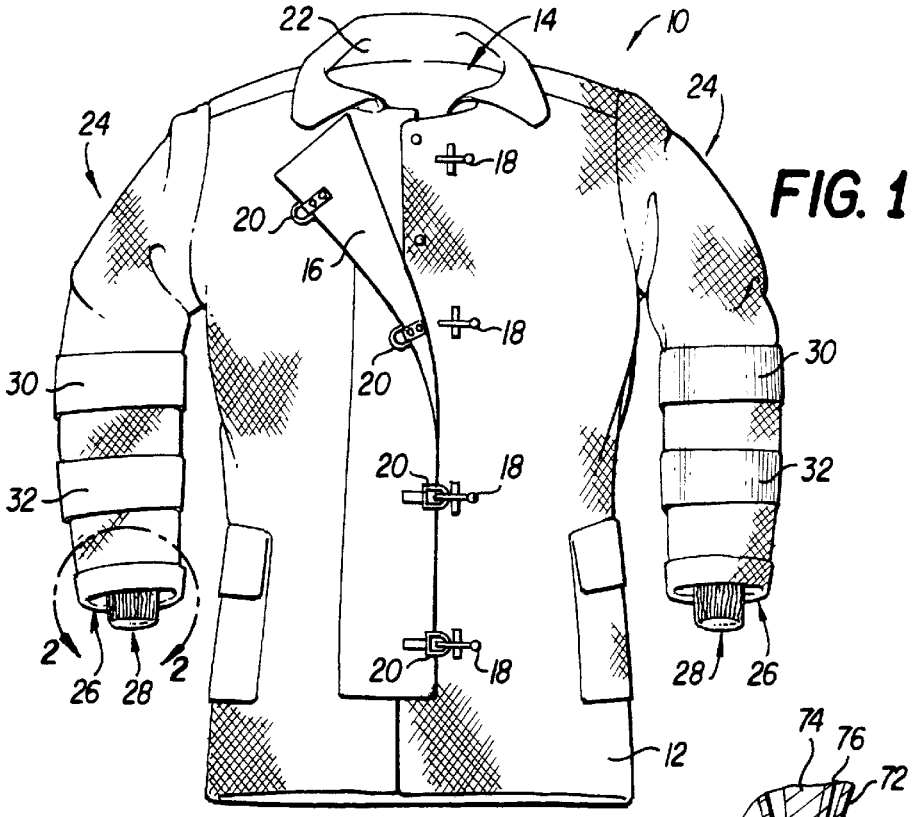
FIG. 1 is an elevation of a firefighter coat according to the invention.

Referring now to the drawings wherein like reference characters designate corresponding parts throughout the several views, there is shown in FIG. 1 a firefighter coat indicated generally by reference numeral 10 and being of conventional construction except for the liner sleeve wells and wristers arrangement hereinafter discussed in detail. The coat includes an outer shell 12 which may be made, for example, of an aramid fabric sold under the tradename NOMEX by F. E. dupont de Nemours & Co., Wilmington, Del, U.S.A. which is fire resistant and which has been treated or coated with a water repellent finish such as neoprene to provide water resistance.

The coat also includes an inner liner 14 having moisture barriers such as neoprene coated cotton material and a thermal barrier in the form of a heat insulating layer formed of NOMEX aramid fibers. The liner may be detachably connected to the shell by hook and loop fastener means such as VELCRO including a pair of interengaging strips of such material disposed along the length of the neck line on the collar facing. The liner is also secured by a plurality of snap fasteners to each coat facing in the usual manner. The sleeves of the liner are detachably connected to the sleeves of the shell as described hereinafter.

The coat includes an outside storm flap 16, and a plurality of hook fasteners 18 cooperate with D-ring fasteners 20 for holding the coat in closed position. A collar 22 is provided and a pair of sleeves 24 depend from the upper side portions of the coat, each of the sleeves terminating in an open lower end 26 having wristers 28 extending therefrom. Light reflective horizontal bands 30 and 32 are stitched to each sleeve of the shell. These bands may be, for example, formed of SCOTCHLITE material sold by 3-M Corp., Minneapolis, Minn., U.S.A.

Figure 3:
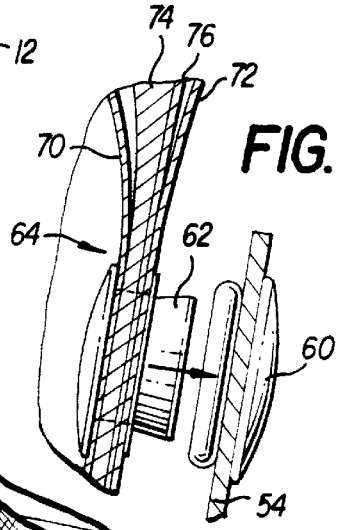
FIG. 3 is an enlarged view of the portion of FIG. 2 as indicated by arrows 3—3 in FIG. 2.
Figure 2:
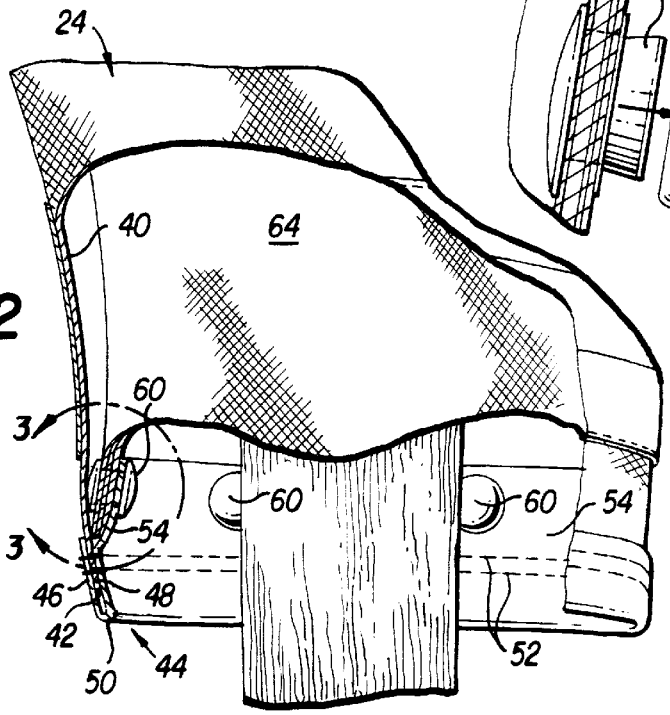
FIG. 2 is a view partly broken away and in section of the portion of FIG. 1 as indicated by arrows 2—2 in FIG. 1, showing the bottom portion of a shell sleeve and an associated liner sleeve of the coat

Referring now to FIGS. 2 and 3, the shell material 40 of sleeve 24 extends downwardly to a lower edge 42. An attachment means 44 is of annular configuration and includes a first annular portion 46 which is disposed in abutting relationship to the outer surface of material 40 of the sleeve. Annular portion 46 joins with annular portion 48 through an integral bight portion 50 the inner surface of which is disposed in spaced relationship to the lower edge 42 of material 40. Annular portion 48 is disposed in abutting relationship to the inner surface of material 40, and annular portions 46 and 48 are secured in place relative to sleeve 24 by two lines of stitching 52 which extend circumferentially around the lower open end of the sleeve. Attachment means 44 may be formed of suede material and also serves as a cuff for the lower end of sleeve 24.

Annular portion 48 of the attachment means joins with an integral annular free annular portion 54, which has secured thereto four conventional female snap fasteners 60 which are equally spaced from one another in a circumferential direction around portion 54 of the attachment means. Referring to FIG. 3, each of the four fasteners 60 is adapted to receive a male snap fastener 62, the four fasteners 62 being supported at the lower open end of the liner sleeve 64 and being equally spaced from one another in a circumferential direction around the liner sleeve. As seen in FIG. 2, when the liner sleeve 64 is secured to the shell sleeve by the snap fasteners 60, 62, the free annular portion 54 of the attachment means overlaps the lower end of the associated liner sleeve 64.

The use of the snap fasteners enables the lower end of the liner sleeve to be readily attached to and detached from the lower end of the shell sleeve in a simple and effective manner. Additionally, when the liner sleeve is attached to the shell sleeve, the overlapping relationship of portion 54 of the attachment means to the lower end of the liner sleeve prevents liquid from flowing between the liner sleeve and the associated shell sleeve when a firefighter lifts his arm. This overlapping relationship also prevents other undesired material from passing between the liner sleeve and the shell sleeve.

Referring to FIGS. 4–6, the lower open end of liner sleeve 64 is indicated at 66. The liner sleeve includes an outer moisture barrier layer 70 and an inner moisture barrier layer 72. Each of these moisture barriers may be formed of neoprene coated cotton material. A thermal barrier is interposed between the two moisture barriers and takes the form of a layer of NOMEX aramid fibers 74 which is quilted by stitching to a facecloth 76 in a conventional manner.

As seen in FIG. 5, the lower edges 70', 72', 74' and 76' of layers 70, 72, 74 and 76 respectively of the liner sleeve are all disposed adjacent the lower open end of the liner sleeve. An annular band of material 80 is folded into a generally U-shaped cross-sectional configuration and is held in place by a line of stitching 82 extending around the lower end of the liner sleeve. A second similar line of stitching 84 extends through layers 70, 72, 74 and 76 of the liner sleeve just above the upper edges of the U-shaped band of material 80.

As seen in FIG. 4 and 6, the inner moisture barrier 72 extends upwardly from the lower end 66 of the liner sleeve a substantial distance where it is connected to the adjacent thermal barrier including layers 74 and 76 by two lines of stitching 90 and 92 whereupon it is folded over as indicated at 94. The inner moisture barrier then extends downwardly a substantial distance to a location where the inner moisture barrier is connected to the associated wrister 28. This wrister is of conventional construction and may be formed of knitted elasticized NOMEX material. The inner moisture barrier 72 is connected to wrister 28 by an annular band of stitching 100 which extends completely around the wrister so that the wrister cannot move away from the associated inner moisture barrier and there is no possibility of undesired material entering between the wrister and the associated inner moisture barrier.

With the foregoing construction, the inner moisture barrier forms a sleeve or water well as indicated at 102 in FIG. 4 which is disposed within the lower portion of the liner sleeve and effectively prevents water from flowing into the interior of the liner sleeve. It is noted that the lower end of the liner sleeve can be located quite close to the lower end of the shell sleeve with this arrangement.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A firefighter coat with liner sleeve wells and wristers comprising, an outer shell having a pair of shell sleeves each of which has an open lower end, a liner within said outer shell and having a pair of liner sleeves each of which is has an open lower end, each of said liner sleeves being disposed within one of said shell sleeves, a pair of wristers, attachment means detachably connecting the lower end of each liner sleeve to the lower end of an associated shell sleeve and preventing liquid from flowing between the liner sleeve and the associated shell sleeve, each liner sleeve including an outer moisture barrier and an inner moisture barrier and a thermal barrier, the thermal barrier of each liner sleeve being disposed between said inner and outer moisture barriers thereof, the inner moisture barrier of each liner sleeve being connected to one of said wristers to form a sleeve well within the associated liner sleeve.

2. A firefighter coat as defined in claim 1 wherein said inner and outer moisture barriers and said thermal barrier of each liner sleeve all have lower edges disposed adjacent the lower end of the associated liner sleeve.

3. A firefighter coat as defined in claim 1 wherein the inner moisture barrier of each liner sleeve is connected to the associated wrister by stitching extending circumferentially around the wrister so that the wrister cannot move away from the associated inner moisture barrier and there is no possibility of undesired material entering between the wrister and the associated inner moisture barrier.

4. A firefighter coat as defined in claim 1 wherein the inner moisture barrier of each liner sleeve extends upwardly from the lower end of and within the associated liner sleeve a substantial distance and is then folded downwardly a substantial distance to the location where the inner moisture barrier is connected to the associated wrister.

5. A firefighter coat as defined in claim 4 wherein said inner moisture barrier of each liner sleeve is connected at an intermediate portion thereof to the associated thermal barrier.

6. A firefighter coat as defined in claim 1 wherein said attachment means of each liner sleeve is annular in configuration and is fixed to the associated shell sleeve, said attachment means including a free annular portion which overlaps the lower end of the associated liner sleeve.

7. A firefighter coat as defined in claim 6 wherein said attachment means includes cooperating fasteners mounted on the associated liner sleeve and shell sleeve.

8. A firefighter coat with liner sleeve wells and wristers comprising, an outer shell having a pair of shell sleeves each of which has an open lower end, a liner within said outer shell and having a pair of liner sleeves each of which is has an open lower end, each of said liner sleeves being disposed within one of said shell sleeves, a pair of wristers, attachment means detachably connecting the lower end of each liner sleeve to the lower end of an associated shell sleeve and preventing liquid from flowing between the liner sleeve and the associated shell sleeve, each liner sleeve including an outer moisture barrier extending upwardly from said lower end of the associated liner sleeve, each liner sleeve also including an inner moisture barrier extending upwardly from said lower end of the associated liner sleeve and forming a sleeve well within the associated liner sleeve, said inner moisture barrier of each liner sleeve being permanently connected to an associated wrister, and each liner sleeve also including a thermal barrier extending upwardly from said open lower end of the associated liner sleeve, said thermal barrier being disposed between said outer moisture barrier and said inner moisture barrier.

9. A firefighter coat as defined in claim 8 wherein the inner moisture barrier of each liner sleeve extends upwardly from the lower end of and within the associated liner sleeve a substantial distance and is then folded downwardly a substantial distance to the location where the inner moisture barrier is connected to the associated wrister, the inner moisture barrier of each liner sleeve being connected at an intermediate portion thereof to the associated thermal barrier adjacent the location where said inner moisture barrier is folded downwardly.

10. A firefighter coat as defined in claim 9 wherein said inner moisture barrier is connected to the associated thermal barrier by stitching extending circumferentially around the inner moisture barrier.

* * * * *